US006702933B2

(12) United States Patent
Alexander

(10) Patent No.: US 6,702,933 B2
(45) Date of Patent: Mar. 9, 2004

(54) PLASTIC BORDER FOR CATHODES

(75) Inventor: Graeme Alexander, Santiago (CL)

(73) Assignee: Refining Technologies, Inc., Santiago (CL)

( * ) Notice: Subject to any disclaimer, the term of this patent is extended or adjusted under 35 U.S.C. 154(b) by 133 days.

(21) Appl. No.: 09/949,117

(22) Filed: Sep. 7, 2001

(65) Prior Publication Data

US 2002/0135326 A1 Sep. 26, 2002

(30) Foreign Application Priority Data

Sep. 7, 2000 (CL) ..... 2442-2000

(51) Int. Cl.[7] ..... C25B 9/00
(52) U.S. Cl. ..... 204/279; 204/281
(58) Field of Search ..... 204/279, 281

(56) References Cited

U.S. PATENT DOCUMENTS

| | | | | |
|---|---|---|---|---|
| 4,776,928 A | * | 10/1988 | Perlich | 204/281 |
| 5,314,600 A | * | 5/1994 | Webb et al. | 204/279 |
| 5,928,482 A | * | 7/1999 | Marttila | 204/281 |
| 6,193,862 B1 | * | 2/2001 | Cutmore et al. | 204/279 |
| 6,264,808 B1 | * | 7/2001 | Marttila | 204/281 |

* cited by examiner

*Primary Examiner*—Bruce F. Bell
(74) *Attorney, Agent, or Firm*—Schnader Harrison Segal & Lewis LLP

(57) ABSTRACT

An improved plastic border utilized in cathodes used in the processes for the electrolytic refinement of minerals, characterized in that the plastic border presents a transversal aperture of a conical like base section with straight walls, thereafter converging with another quadrangular aperture, to end in an oblong section aperture opening.

3 Claims, 3 Drawing Sheets

PLASTIC BORDER FOR CATHODES

DESCRIPTION OF THE INVENTION

The present invention relates to improvements to the plastic borders for cathodes, used in the electrolytic refinement of metals.

BACKGROUND OF THE INVENTION

The basic process is that of an electrolytic cell, which in its interior contains a series of anodes and cathodes submerged in an electrolytic solution or bath. The cathodes are metal sheets generally of a dimension of a square meter and of a few millimeters in thickness. When energy is applied, the metallic ions dissolved in the solution are deposited in the cathode. However, the metallic ions are not deposited where a plastic border, or other non-conducive materials are placed, on the surface of the cathode. Covering certain parts of the cathode allows the deposited metal to be removed easily as a separate sheet, which has grown to the desired thickness.

These borders for cathodes are manufactured preferably of a plastic material, which is extruded to render different forms. A diversity of cathodes are known in the electrolytic refinement of metals.

One such cathode is known in Chilean Patent No. 35,541, provided with a support bar and a planar stainless steel outside face, secured to the bar and provided with electrical insulation strips on its edges, at least on the vertical and longitudinal edges. Each longitudinal edge on its front face having a slot with a strip of modified borders in its interior which extend beyond the other borders throughout its length. The border strip being manufactured of natural or synthetic polymers. The insulation strip of the border is modified in the interior of a slot in the form of a kite tail which is formed by a longitudinal fold of a polymer sheet, at which fold (bend) is situated a stainless steel wire and where the halves of the superimposed and joining sheets are joined so that they provide an air tight seal against liquids.

BRIEF DESCRIPTION OF THE DRAWINGS

In order to be able to better understand the characteristics of the plastic borders for cathodes in electrolytic refinement, these shall be described with reference to the drawings that are detailed hereinafter.

DETAILED DESCRIPTION OF THE INVENTION

Figure 1:
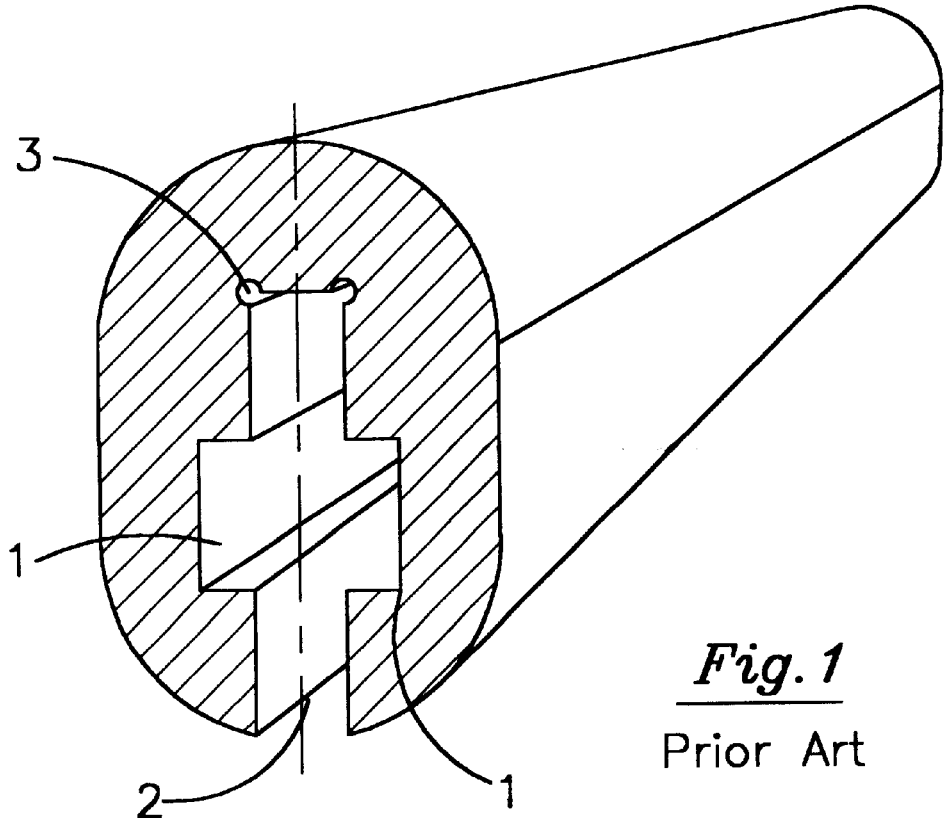
Fig. 1 Prior Art
FIG. 1 consists of a perspective frontal view of the plastic border known in the prior art.
Figure 2:
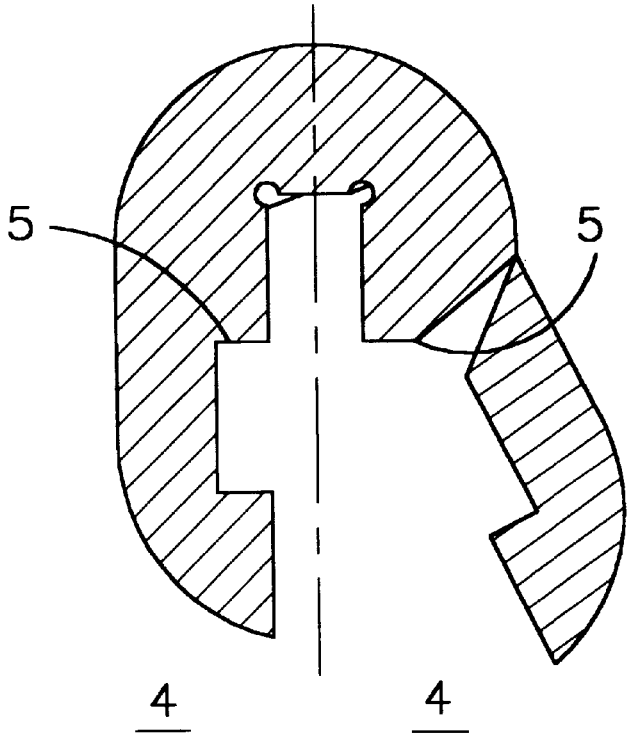
Fig. 2 Prior Art
FIG. 2 consists of a sectional view of the plastic border of the prior art, which shows the problems of its shape.
Figure 3:
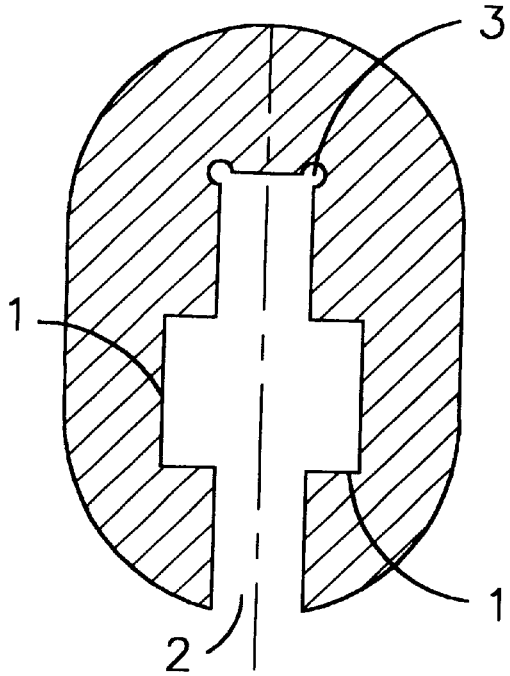
Fig. 3 Prior Art
FIG. 3 consists of a sectional view of the plastic border of the prior art.

In accordance with FIGS. 1–3, the prior art plastic border presents two channels (1) that travel the length of the profile at each side of a central channel (2) and this permits the plastic border to be securely attached to the border of the cathode through internal securing clips. The second design characteristic of the prior art border are two small channels (3) that pass through the length of the profile at the end of the central channel. The plastic border of the cathode is inserted within the central channel (2) of the plastic border. This opens the plastic border approximately in 0.5 mm., so that the borders may slide over the clips that are inserted in the holes or openings along the length of the cathode. The two smaller channels (3) allow the plastic border to be opened without tearing.

While the internal clip mechanism is an evident benefit in design, it presents a problem due to the occlusion of the electrolyte in the side channels (1) around the clips. When the cathode is raised from the electrolyte bath, the side channels need to release the trapped electrolyte within and the process can be halted for a few minutes, which requires a waiting period for this to occur.

Another problem which exists at present with this design for plastic borders is illustrated in FIG. 2 and occurs when the metallic deposit is collected from the cathode, pulling open the plastic border (4) and subjecting an enormous strain on the upper vertices (5) of the channel sections (1). At a result, successive usage will weaken the plastic border and fracture may occur at the upper vertices (5).

Figure 4:
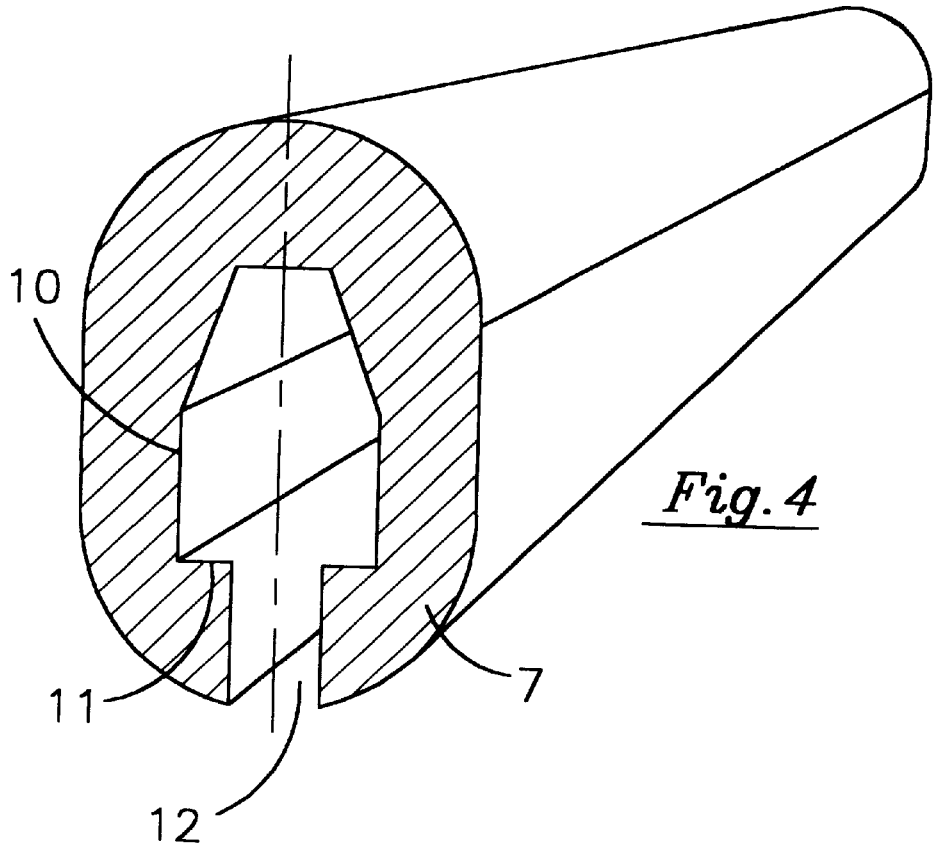
FIG. 4 is a perspective view of the plastic border of the present invention.
Figure 5:
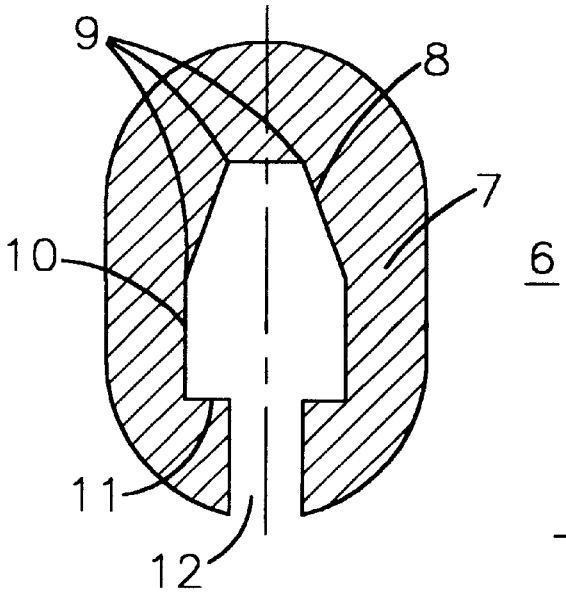
FIG. 5 is a cross-sectional view of the border of the present invention.
Figure 6:
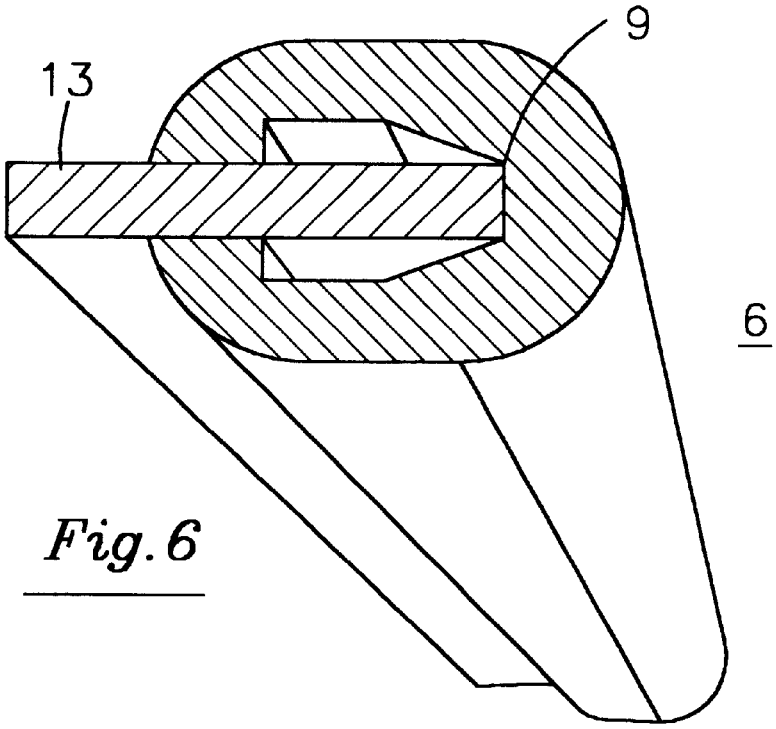
FIG. 6 is a perspective view of the border of the present invention when placed on a cathode.

In accordance with FIG. 4, the plastic border (6) of the present invention for use with a cathode (13) is provided with an elongated exterior body of rectangular transverse section (7). This body provides an upper transversal opening of the pyramidal base section (8), whose form allows for more extensive interior angles (9) than the prior art, as depicted in FIGS. 1, 2 and 3, (i.e. greater than 90°) which facilitates the aperture of the plastic border (6) and also avoids mechanical strains, thereby providing a longer service life for the plastic border. Then it converges with another aperture of the quadrangular section (10) to end in planar reductions (11) on both entrances (12) that open outwardly by a flank. The interior of the plastic border (6) thus forms a rectangular slot opening or entrance (12) for attachment to a cathode. The entrance (12) communicates with an internal cavity having a first generally rectangular cross-section area and a second, generally trapezoidal cross-sectional area connected thereto. The internal cavity has a cross-section with a plurality of internal angles of greater than 90°, and in a preferred embodiment all internal angles are greater than 90°.

What I claim is:

1. A plastic border for use in cathodes for the electrolyte refinement of metals comprising an elongated plastic body having an internal cavity wherein the cavity has a cross-section in the shape of a rectangle with a trapezoid attached thereto where the length of the longer base of the trapezoid and the length of one side of the rectangle are equal; the cavity communicating with the outside of the border through a rectangular opening.

2. In a plastic border for a cathode used in the electrolytic refining of metals wherein the border comprises an elongated body having an internal cavity and an opening for receiving the cathode, the improvement comprising an internal cavity having a cross-section with a plurality of internal angles of greater than 90°.

3. The border of claim 2 where all internal angles in said internal cavity are greater than 90°.

* * * * *